US005438397A

United States Patent [19]

Okano et al.

[11] Patent Number: 5,438,397

[45] Date of Patent: Aug. 1, 1995

[54] IMAGE FORMING APPARATUS

[75] Inventors: Yoshiaki Okano; Tetsuya Nakamura, both of Tokyo, Japan

[73] Assignee: Kabushiki Kaisha Toshiba, Kanagawa, Japan

[21] Appl. No.: 216,867

[22] Filed: Mar. 24, 1994

[51] Int. Cl.[6] ..... G03G 15/06

[52] U.S. Cl. ..... 355/269; 355/301

[58] Field of Search ..... 355/296, 301, 303, 297, 355/246, 269, 270; 118/652, 653, 661; 15/256.52

[56] References Cited

U.S. PATENT DOCUMENTS

| | | | |
|---|---|---|---|
| 4,754,304 | 6/1988 | Ohashi et al. | 355/270 |
| 4,769,676 | 9/1988 | Mukai et al. | 355/269 |
| 4,999,679 | 3/1991 | Corbin et al. | 355/303 |
| 5,124,757 | 6/1992 | Ikegawa | 355/296 |
| 5,200,789 | 4/1993 | Oshiumi | 355/296 |
| 5,233,398 | 8/1993 | Nimura et al. | 355/301 |
| 5,237,377 | 8/1993 | Harada et al. | 355/301 |
| 5,241,327 | 8/1993 | Rubin et al. | 346/76 L |
| 5,257,079 | 10/1993 | Lange et al. | 355/303 |

*Primary Examiner*—A. T. Grimley
*Assistant Examiner*—T. A. Dang
*Attorney, Agent, or Firm*—Finnegan, Henderson, Farabow, Garrett & Dunner

[57] ABSTRACT

An image forming apparatus includes a brush member arranged along a photosensitive member and arranged between a transfer roller means and a charger. The image forming apparatus further includes a first voltage supply for supplying a first voltage which is sufficient to attract residual toner remaining on the photosensitive member to the brush member during a first period when an exposed area that is to be exposed by the exposing means passes the brush member, the first period occurring before the exposed area reaches the exposing means, and a second voltage supply for supplying a second voltage which is sufficient to spit the attracted toner attracted in the brush member at the photosensitive member during at least a part of a second period when a non-exposed area that is on a different area of the photosensitive member from the exposed area passes the brush member, the second period occurring before the non-exposed area reaches the exposing means.

15 Claims, 7 Drawing Sheets

IMAGE FORMING APPARATUS

BACKGROUND OF THE INVENTION

1. Field of the Invention

The present invention generally relates to an image forming apparatus, such as a facsimile and a copying apparatus, and more particularly to an image forming apparatus which has a developing device which removes a residual toner on a photosensitive member to the developing device.

2. Discussion of the Related Art

FIG. 12 shows a conventional image forming apparatus. The apparatus forms an image on a sheet of paper P by devices such as a charging device 100, an exposure device 102, a developing device 104, and a transfer device 106 provided around a photosensitive drum 108 rotating in a direction S. The charging device 100 charges the photosensitive drum 108. The exposure device 102 exposes the charged photosensitive member to form a latent image on the photosensitive drum 108. The developing device 104 includes a toner hopper 131 a feed roller 132, a developing roller 134, a direct-current power source 136, an alternating-current power source 138. The direct-current power source 136 biases a predetermined voltage against alternating-current voltage from the alternating power source 138. The toner contained in the toner hopper 131 is conveyed by the feed roller 132 to the developing roller 134. The developing roller 134 develops the latent image with the conveyed toner to form a developed toner image on the image on the photosensitive drum 108 to the sheet of paper P. In this state, some residual toner remains on the photosensitive drum 108. This residual toner blocks the light from the exposure device 102. In order to overcome this deficiency, the apparatus further includes a discharge device 110 and a distribution roller 112 rotating in a direction U, both of which are located between the transfer device 106 and the charging device 100.

The discharge device 110 includes a discharge charger 114. The discharge charger 114 is coupled to a condenser 116, which, in turn, is coupled to an alternating-current power source 118. Then, the discharge charger 114 discharges onto the photosensitive drum 108 so that the positive and negative charges are balanced. Simultaneously, a mirror 122 reflects light from a discharge lamp 120 onto the photosensitive drum 108. As a result, the charge on the photosensitive drum 108 and the charge of the residual toner are zero. Therefore, the residual toner is not bound to the photosensitive drum 108. In this state, the residual toner remaining on the photosensitive drum 108 arrives at the distribution roller 112, which is coupled to a positive direct-current power source 124. The residual toner comes into sliding contact with the distribution roller 112, which spreads the residual toner across the surface of the photosensitive drum 108. By spreading the residual toner across the surface of the photosensitive drum 108, the distribution roller 112 removes accumulations of residual toner having a thickness that would prevent the light from exposure device 102 from reaching the underlying surface of the photosensitive drum 108 Therefore, the light from the exposure device 102 may reach the entire surface area of the photosensitive drum 108.

However, the conventional apparatus requires two separate structural elements to spread the residual toner on the photosensitive drum 1 (e.g., the discharge device 110 having the charging device 114 coupled to the alternating-current power source 118, and the distributing roller 112 coupled to the direct-current power source 124). Thus, the apparatus becomes bulky and heavy.

SUMMARY OF THE INVENTION

Accordingly, the present invention has been made in view of the above circumstances and has an object to provide a smaller and more compact image forming apparatus having a decreased number of components for dealing with the residual toner on a photosensitive drum, compared to the conventional apparatus.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as the appended drawings.

To achieve these and other objects and advantages and in accordance with the purposes of the invention, there is provided an image forming apparatus comprising a photosensitive member, charging means for charging the photosensitive member, exposing means for exposing the charged photosensitive member to form a latent image and a non-exposed area on the photosensitive member, developing means for developing the latent image with toner to form a developed toner image on the photosensitive member, transferring means for transferring the developed toner image to a sheet-like material, a brush member arranged along the photosensitive member and arranged between the transferring means and the charging means, first voltage supply means for supplying a first voltage which is sufficient to attract residual toner remaining on the photosensitive member to the brush member during a first period when an exposed area that is to be exposed by the exposing means passes the brush member, the first period occurring before the exposed area reaches the exposing means, second voltage supply means for supplying a second voltage which is sufficient to spit the attracted toner attracted in the brush member at the photosensitive member during at least a part of a second period when a non-exposed area that is on a different area of the photosensitive member from the exposed area passes the brush member, the second period occurring before the non-exposed area reaches the exposing means, and removing means for removing the spit toner on the photosensitive member by transferring the spit toner from the photosensitive member to the developing means, the removing means being operated simultaneously with the developing means.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate several embodiments of the invention and, together with the description, serve to explain the objects, advantages, and principles of the invention. In the drawings.

DESCRIPTION OF THE PREFERRED EMBODIMENTS

Reference will now be made in detail to the present preferred embodiments of the invention, examples of which are illustrated in the accompanying drawings.

Figure 1:
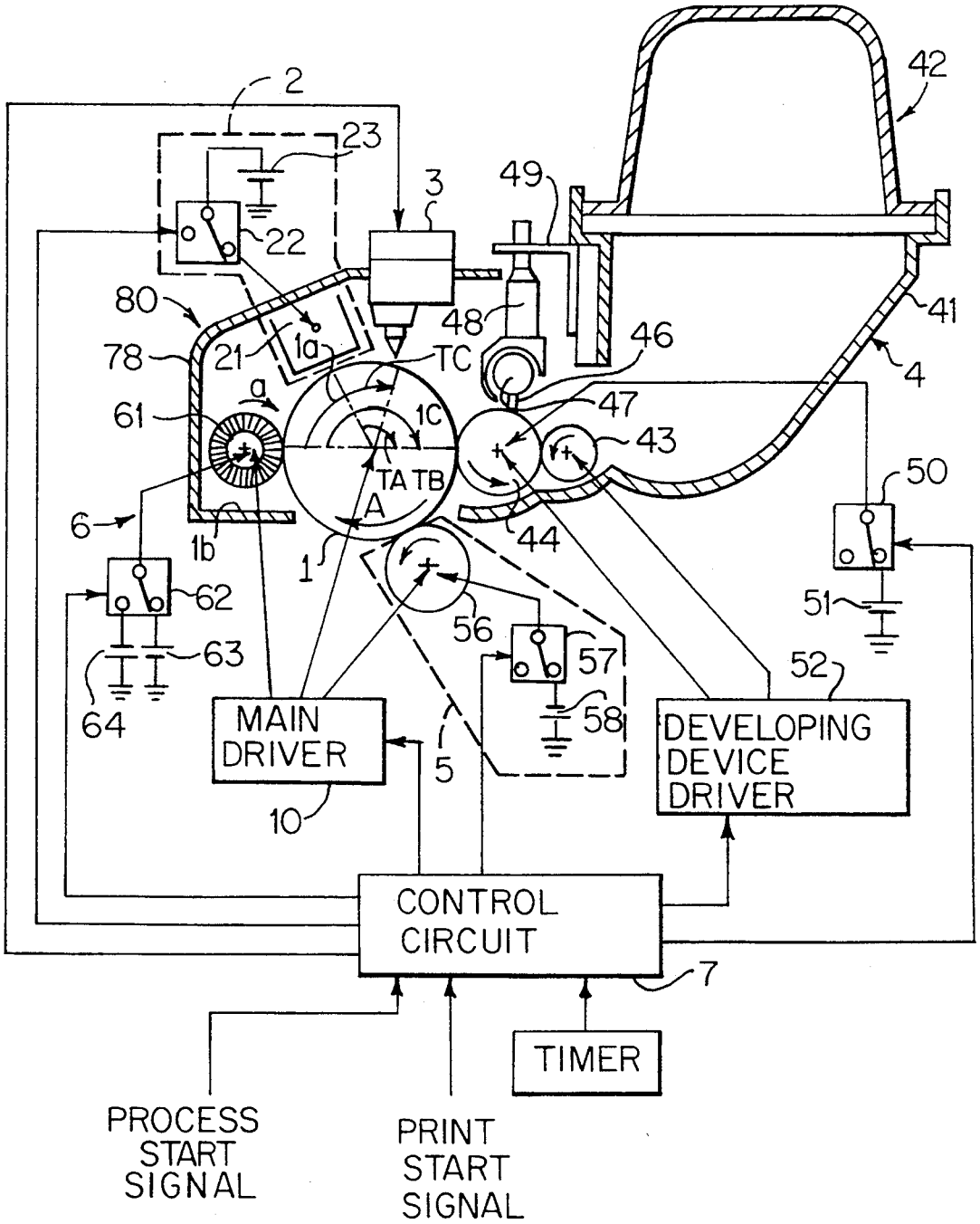
FIG. 1 is a schematic view illustrating an image forming apparatus according to an embodiment of the present invention.

FIG. 1 shows the structure of the image forming apparatus constructed according to a first embodiment of the present invention. The image forming apparatus includes a photosensitive drum 1, a charging device 2, an exposure device 3, a developing device 4, a transfer device 5, and a distributing device 6 arranged around the outer surface of a photosensitive drum 1. 0f these components, the photosensitive drum 1, the charging device 2, and the developing device 4 are integrally supported by side covers 78 to form a process unit 80.

The photosensitive drum 1 is positively charged and includes a photosensitive layer having an organic photoconductor, preferably including perylene pigment, phthalocyanine pigment, hydrazone derivative and polycarbonate.

A main driver 10 rotates the photosensitive drum 1 in a clockwise direction A in accordance with a signal from a control circuit 7.

The charging device 2 includes a charger 21, a charging switch 22, and a charging power source 23. The charging switch 22 connects the charger to the charging power source 23 in accordance with a signal from the control circuit 7. In accordance with the signal, the charging device 2 charges the surface of the photosensitive drum 1 to the predetermined voltage (e.g., +600 V).

The exposure device 3 preferably includes an LED array (not shown) which can be controlled in response to an image data of an image to be recorded from the control circuit 7.

The developing device 4 comprises a toner hopper 41, a toner pack 42, a feed roller 43, a developing roller 44, a developing blade 46, a cylindrical support rod 47, a spring 48, a support 49, a developing power source switch 50, a developing power source 51, and a developing device driver 52.

The toner hopper 41 is a hollow container whose upper surface is partially open, for storing toner (not shown) therein. The toner pack 42 is mounted on an upper open portion of the toner hopper 41. The toner pack 42 is filled with toner, and its opening is sealed with a seal sheet (not shown). When the toner pack 42 is mounted on the toner hopper 41 and the seal sheet is removed, the toner empties into the toner hopper 41.

The feed roller 43 is arranged at an opening on the side surface of the toner hopper 41 such that it is partly located in the toner hopper 41. The developing roller 44 lightly contacts both the photosensitive drum 1 and the feed roller 43. The developing device driver 52 rotates the feed roller 43 and the developing roller 44 in the counterclockwise direction in accordance with a signal from the control circuit 7. The feed roller 43 carries the toner stored in the toner hopper 41 and supplies it to the developing roller 44. The developing roller 44 carries the toner provided by the feed roller 43 and causes it to contact the surface of the photosensitive drum 1.

The developing power source switch 50 connects the developing roller 44 to the developing power source 51 in accordance with a signal from the control circuit 7. In accordance with the signal, the developing power source 45 supplies a predetermined developing bias, e.g., 300 V, to the developing roller 44.

The cylindrical support rod 47 is arranged parallel to and above the developing roller 44 to support the developing blade 45 in contact with the developing roller 44. The spring 48, which is fixed to the support 49, urges the support rod 47 toward the developing roller 44 with a predetermined force. Thus, the developing blade 46 is urged against the developing roller 44. The support 49 is fixed to the side wall of the toner hopper 41.

The transfer device 5 includes a transfer roller 56. The main driver 10 rotates the transfer roller 56 in a counterclockwise direction in contact with the photosensitive drum in accordance with a signal from the control circuit 7. The transfer device 5 further includes a transfer power source 52, a switch 57 and a transfer power source 58. The transfer power source switch 57 connects the transfer roller 56 to the transfer power source 58 in accordance with a signal from the control circuit 7. In accordance with the signal, the transfer power source 58 supplies a predetermined voltage, e.g., −1350 V.

The brush device 6 includes a rotating brush 61, a brush power source switch 62, a positive brush power source 63, and a negative brush power source 64. The rotating brush 61 is made of a rayon material that preferably includes carbon. The rotating brush has 61 is approximately $1.7\times106^{6}$ W. The main driver 10 rotates the rotating brush 61 in a clockwise direction a in contact with the photosensitive drum 1 in accordance with a signal from the control circuit 7. The brush power source switch 62 selectively connects the rotating brush 61 to one of the positive and negative power sources 63, 64 in accordance with a signal from the control circuit 7. The positive power source 63 generates +300 V and the negative power source 64 generates −300 V.

Figure 2:
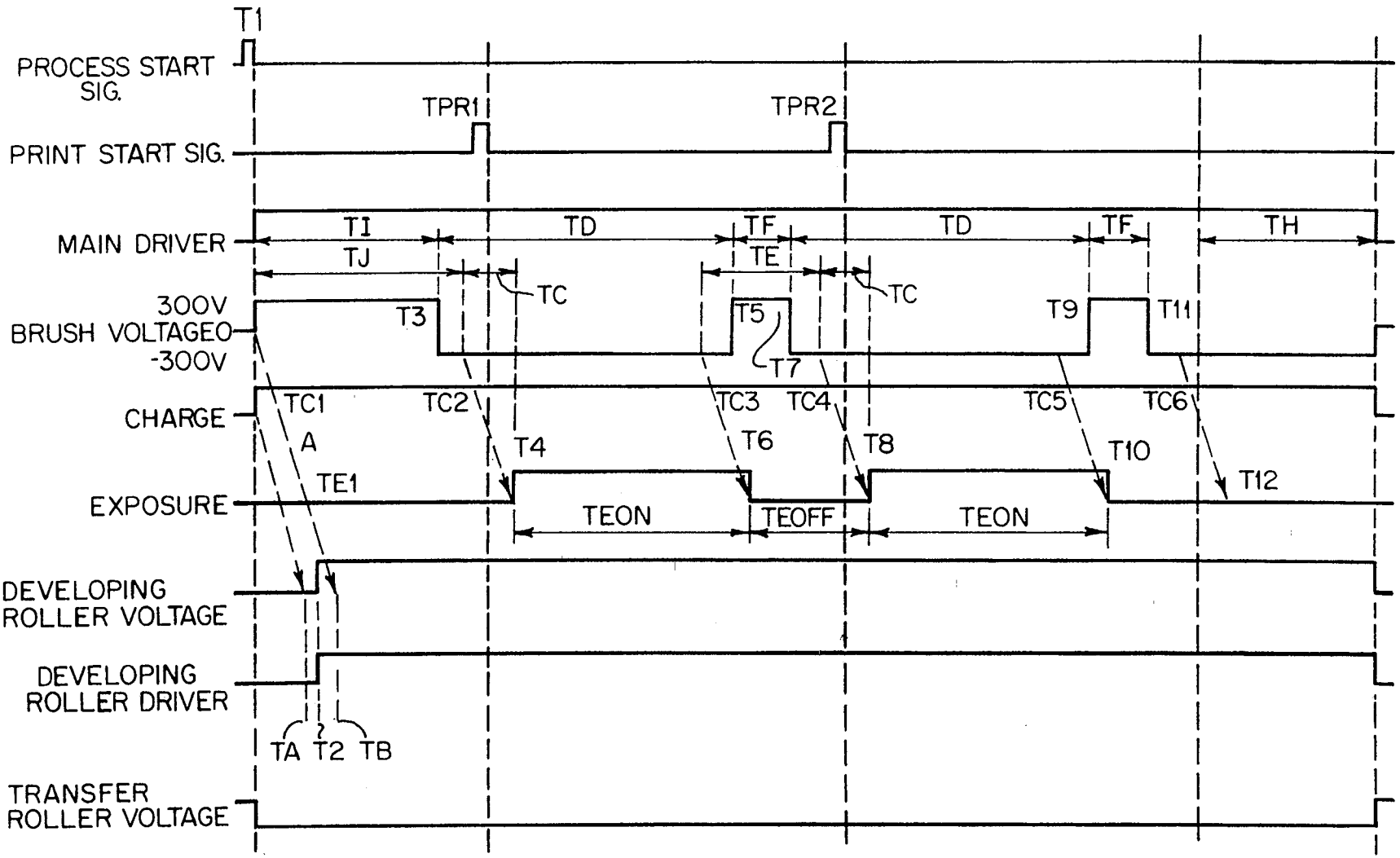
FIG. 2 is a timing chart illustrating a printing sequence performed by the apparatus shown in FIG. 1.

A printing sequence will be described in detail with reference to a timing chart of FIG. 2.

If the control circuit 7 receives a process start signal in a circuit 7 causes the main driver 10 to start driving the photosensitive drum 1, the transfer roller 56, and the rotating brush 61 (a timing T1). Furthermore, at the time T1, the control circuit 7 provides a signal to the brush power source switch 62 so that the switch 62 connects the rotating brush 61 to the positive power source 63 (300 V). As a result, toner having positive charge, which was attracted in the rotating brush 61 during a previous sequence, is spit at the surface of the photosensitive drum 1 having a potential (200 V at most, due to the transfer voltage −1350 V of the transfer roller 56 after the surface passes the transfer roller 56), which is less than the voltage of the rotating brush 61 (300 V). When the area of the photosensitive drum 1 at which the toner is spit moves to a position adjacent the exposure device 3, as shown by a dotted line A of FIG. 2, the exposure device 3 does not expose the area (hereinafter called the non-exposed area). Therefore, the spit toner does not prevent the light from the exposure device 3 from reaching a surface of the photosensitive drum 1.

Furthermore, at the time T1, the control circuit 7 actuates the charging power source switch 22 so that the switch 22 connects the charging device 21 to the charging power source 23, and furthermore actuates the transfer power source switch 57 so that the switch 57 connects the transfer roller 56 to the transfer power source 58.

Subsequently, at a time T2, the control circuit 7 actuates the developing power source switch 50 to be connected to the developing device power source 51 and causes the developing device driver 52 to start rotating the developing roller 44 and the feed roller 43.

Referring again to FIG. 1, assume that at the time T1, the photosensitive drum 1 has a charging point 1*a* which is located at the charging device 21 and a brush point 1*b* which is located at the rotating brush 61, and a developing point 1*c* which is located at the developing roller 44. A surface from the developing point 1*c* to the charging point 1*a* is not charged by the charging device 21 while the photosensitive drum 1 firstly rotates in a clockwise direction after the control circuit 7 receives the process start signal. Before the control circuit 7 receives the process start signal at the time T1, the image forming apparatus is set to be in a standby state. In this state, the potential of the non-charged surface of the photosensitive drum 1 decreases as time passes. As a result, the surface of the photosensitive drum 1 has a potential less than the developing bias, e.g., 300 V.

In order to prevent the toner on the developing roller 44 from attaching to the non-charged surface having the potential less than the developing bias, the control circuit 7 does not start rotating the developing roller 44 while the non-charged surface passes the developing roller 44. That is, the control circuit 7 starts rotating the developing roller 44 at or after a time TA at which the charging point la reaches the developing roller 44.

Figure 3:
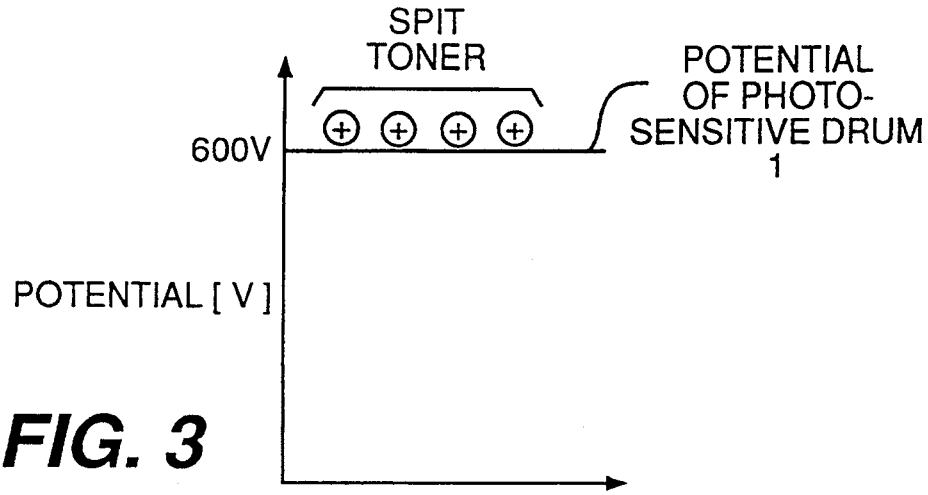
FIG. 3 is a diagram illustrating a potential at a photosensitive drum during a charge period according to the first embodiment shown in FIG. 1.
Figure 4:
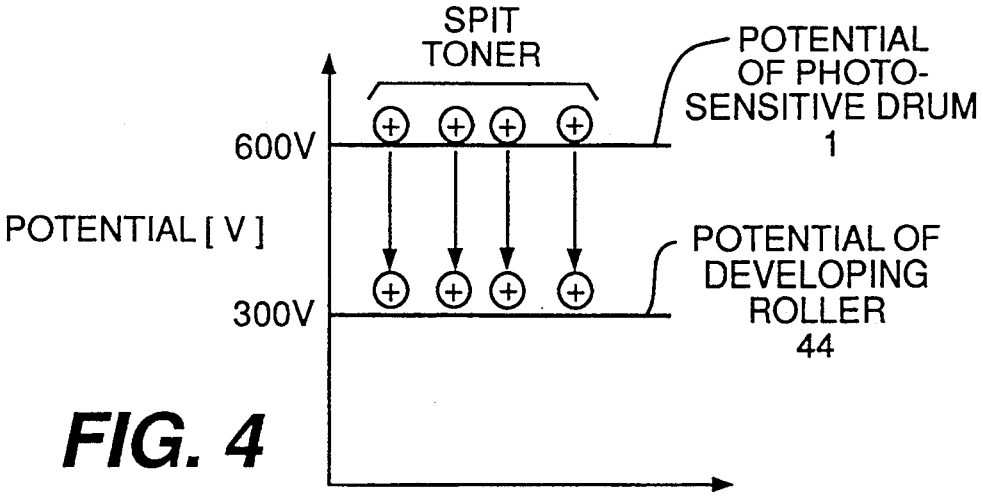
FIG. 4 is a diagram illustrating a potential at a photosensitive drum and a developing roller in the apparatus in FIG. 1 when the photosensitive drum reaches the developing roller.

After that, the brush point 1*b* reaches the developing roller 44 at a time TB as a result of the further rotation of the photosensitive drum 1. The brush point 1*b* has the spit toner spit by the rotating brush 61 at the time T1. Further, since the brush point 1*b* passes the charging device 21, the brush point 1*b* is charged at 600 V as shown in FIG. 3. On the contrary, as shown in FIG. 4, the potential at a portion of the developing roller 44 conveying the toner is 300 V. The control circuit 7 starts rotating developing roller 44 at or before the time TB at which the brush point 1*b* reaches the developing roller 44. Therefore, as shown in FIG. 4, the developing roller 44 attracts the spit toner on the brush point 1*b* of the photosensitive drum 1 to the developing roller 44. As a result, the spit toner is removed from the photosensitive drum 1.

Therefore, the time T2 is expressed by the following expression.

$$TA \leqq T2 \leqq TB$$

The rotating brush 61 is continuously supplied with the positive voltage from the time T1 to a time T3. This period TI is during at least a part of a period TJ during which the non-exposed area of the photosensitive drum 1 that will not be exposed by the exposure device 3 passes the rotating brush 61 before the non-exposed area reaches the exposure device 3. Since the potential at the rotating brush 61 (300 V) is more positive than the potential at the surface of the photosensitive drum 1 (200 V at most due to the transfer voltage −1350 V of the transfer roller 56), the toner in the rotating brush 61 is spit to the non-exposed area of the photosensitive drum 1.

The non-exposed area having the spit toner moves to the charger 21 as a result of the continuous rotation of the photosensitive drum 1. During a period from a time TC1 to a time TC2, as shown in FIG. 3, the non-exposed area conveying the spit toner is charged at 600 V by the charger 21. Further, the non-exposed area moves to the exposure device 3 as a result of the rotation of the photosensitive drum 1. During a period from a time TE1 to a time T4, the exposure device 3 does not expose the non-exposed area of the photosensitive drum 1. Therefore, since the toner is spit to the non-exposed area, the spit toner does not interrupt the exposure light from the exposure device 3.

Furthermore, the non-exposed area moves to the developing roller 44 as a further result of the rotation of the photosensitive drum 1. At that time, as shown in FIG. 4, since the potential at the developing roller 44 (300 V) is less positive than that at the non-exposed area of the photosensitive drum 1 (600 V), the spit toner on the non-exposed area of the photosensitive drum 1 is removed from the non-exposed area to the developing roller 44.

When a predetermined period expires from the time T1 (at a time TPR1), the control circuit 7 receives a print start signal from the main control circuit (not shown). Further, when a predetermined period expires from the time TPR1 (at the time T4), the control circuit 7 causes the exposure device 3 to start exposing the photosensitive drum 1.

Prior to the exposure and before an area to be exposed reaches the exposure device 3 and before the area passes the rotating brush 61, the control circuit 7 switches the voltage of rotating brush 61 from the positive to the negative in order not to spit the toner in the rotating brush 6 to the area of the photosensitive drum 1 that will be exposed (hereinafter called "the exposed area") when it reaches the exposure device 3. Specifically, the control circuit 7 causes the switch 62 to be connected to the negative power source 64 at a time T3. The time T3 is before the time T4 by more than a predetermined period TC, during which the brush point 1*b* reaches the exposure device 3. While the exposed area passes the rotating brush 61 before the exposed area reaches the exposure device 3, the rotating brush 61 is supplied with the negative voltage which is sufficient not to spit the toner in the rotating brush 61 to the exposed area. Specifically, the negative voltage is −300 V which is less positive than the potential of the exposed area having approximately 200 V due to the transfer voltage of the transfer roller 56. After the exposed area not having the toner moves to the charger 21, the exposed area is charged by the charger 21 at 600 V from the time TC2 to a time TC3. After the exposed charged area moves to the exposure device 3, the exposure device 3 exposes the charged exposed area to form a latent image from the time T4 to a time T6 corresponding to a first period TEON. Therefore, since the rotating brush 61 does not accumulate the toner on the exposed area before the exposed area reaches the exposure device 3, the light from the exposure device 3 reaches the surface of the photosensitive drum 1. After a predetermined period TD from the time T3 to a time T5, the control circuit 7 switches the voltage to the rotating brush 61 from negative to positive voltage. The period TD is longer than a period during which the exposed area passes the rotating brush 61.

Figure 5:
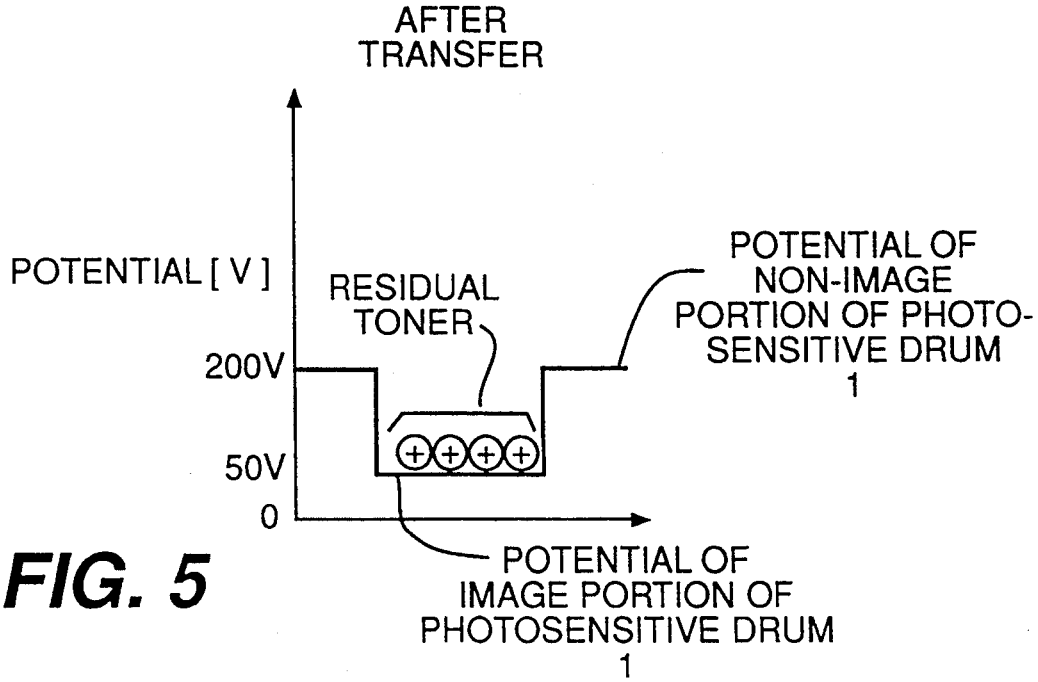
FIG. 5 is a diagram illustrating a potential at a transfer portion of the photosensitive drum conveying residual toner in the apparatus in FIG. 1 after a transfer of a toner image on the photosensitive drum to a sheet of paper is performed.

The exposed area further moves to the developing roller 44 as a result of the continuous rotation of the photosensitive drum 1. In this state, the developing roller 44 develops the exposed area including the latent image with toner to form a developed toner image on the photosensitive drum 1. Furthermore, when the developed area having the developed toner image moves to the transfer roller 56, the transfer roller 56 transfers the developed toner image to a sheet of paper. As shown in FIG. 5, after the transfer, residual toner remains on an image portion of the photosensitive drum 1. In this state, the potential of the image portion is 50 V, and the potential of the non-image portion is 200 V. The transfer area of the photosensitive drum 1 conveying the residual toner moves to the rotating brush 61.

Referring again to FIG. 2, at the time T5, the control circuit 7 switches the voltage to the rotating brush 61 from the negative voltage to the positive voltage.

Figure 6:
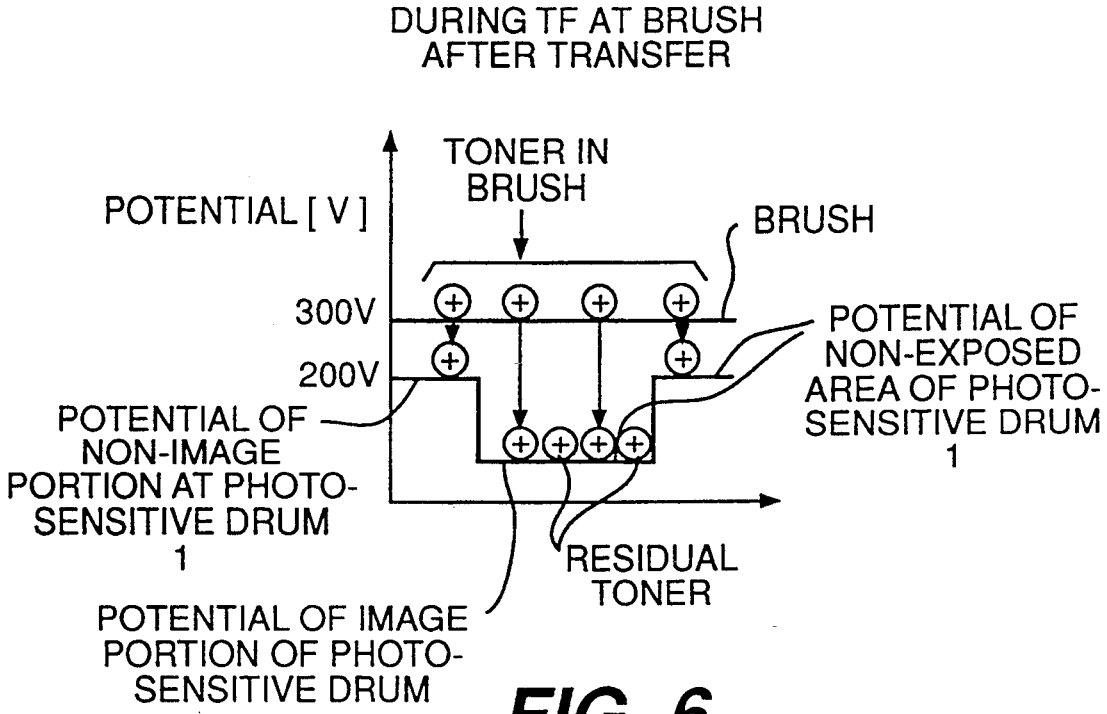
FIG. 6 is a diagram illustrating a potential at a rotating brush and a non-exposed area of the photosensitive drum in the apparatus in FIG. 1.

Thereafter, the rotating brush 61 is supplied with the positive voltage during at least a part of a period TE during which the non-exposed area of the photosensitive drum 1 that will not be exposed by the exposure device 3 passes the rotating brush 61 before the non-exposed area reaches the exposure device 3. As shown in FIG. 6, since the potential at the rotating brush 61 supplied with the positive voltage (300 V) is more positive than the potential at the photosensitive drum 1 (200 V at most) after the transfer, the attracted toner in the rotating brush 61 is spit to the non-exposed area including the image portion and the non-image portion of the photosensitive drum 1. Therefore, since the attracted toner in the rotating brush 61 is spit to the non-exposed area, the spit toner does not interrupt the exposure light from the exposure device 3.

Referring again to FIG. 2, the rotating brush 61 is supplied with the positive voltage during a period TF from the time T5 to a time T7 in order to spit the toner to the non-exposed area of the photosensitive drum 1.

The non-exposed area having the spit toner moves to the charger 21 as a result of the continuous rotation of the photosensitive drum 1. During a period from the time TC3 through a time TC4, as shown in FIG. 3, the non-exposed area conveying the spit toner is charged at 600 V. Further, the non-exposed area moves to the exposure device 3 as a result of the rotation of the photosensitive drum 1. During a time period TEOFF from the time T6 to the time T8, the exposure device 3 does not expose the non-exposed area of the photosensitive drum 1. Therefore, since the toner is spit to the non-exposed area, the spit toner does not interrupt the exposure light from the exposure device 3.

Furthermore, the non-exposed area moves to the developing roller 44 as a further result of the rotation of the photosensitive drum 1. At that time as shown in FIG. 4, since the potential at the developing roller 44 (300 V) is less positive than that at the non-exposed area of the photosensitive drum 1 (600 V), the spit toner on the non-exposed area of the photosensitive drum 1 is removed from the non-exposed area to the developing roller 44.

Figure 7:
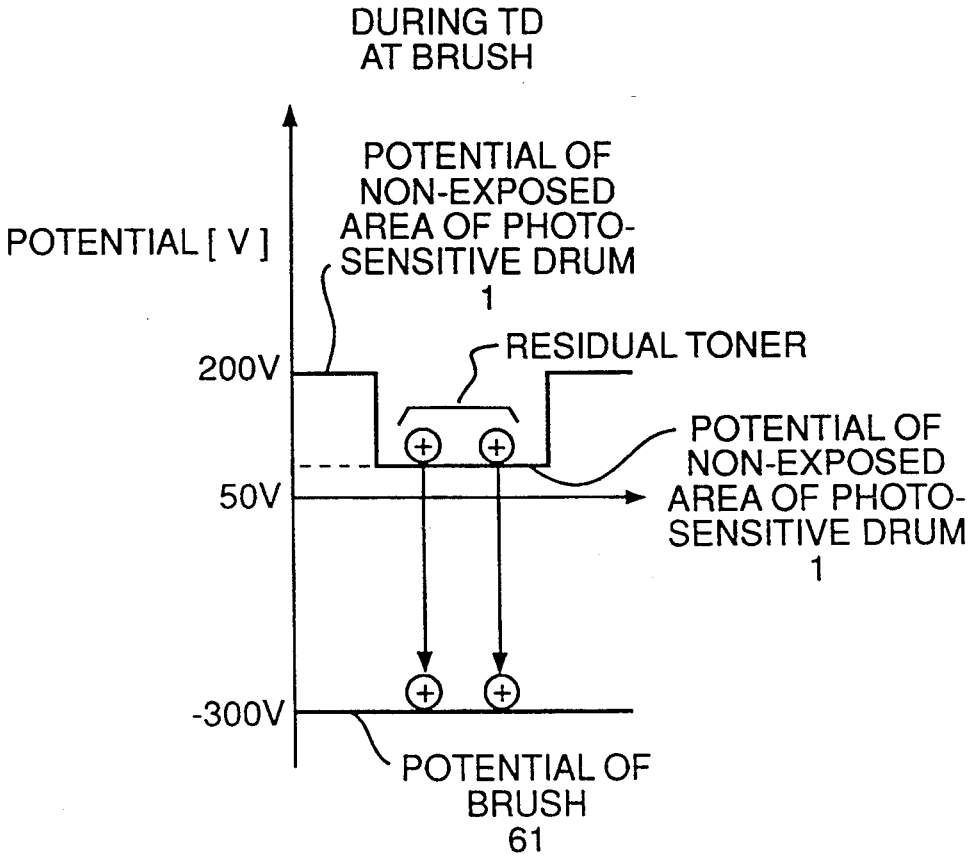
FIG. 7 is a diagram illustrating a potential at the rotating brush and an exposed area of the photosensitive drum in the apparatus in FIG. 1.

At the time T7, the control circuit 7 actuates the brush power source switch 62 to be connected to the negative power source 64 in order to attract the residual toner remaining on the photosensitive drum 1 to the rotating brush 61. As shown in FIG. 7, since the potential at the image portion of the photosensitive drum 1 conveying the residual toner (50 V) is more positive than that at the rotating brush 61 connected to the negative voltage (−300 V), the residual toner is attracted to the rotating brush 61.

In this state, if the control circuit 7 receives a next print signal from the main control circuit 7 at a time TPR2, the control circuit 7 causes the exposure device 3 to generate light including a next page data to the photosensitive drum 1 at a time T8.

The time T7 is before the time T8 by more than the period TC, during which the brush period point 1*b* reaches the exposure device 3. Further, while the next exposed area passes the rotating brush 61 before reaching the exposure device 3, the rotating brush 61 is supplied with the negative voltage which is sufficient to attract the residual toner remaining on the next exposed area of the photosensitive drum 1 to the rotating brush 61. The rotating brush 61 is supplied with the negative voltage during a period TD from the time T7 to a time T9. During this period, since the rotating brush 61 attracts the residual toner from the next exposed area.

After the next exposed area not having the residual toner moves to the charger 21, the next exposed area is charged by the charger 21 at 600 V from the time TC4 to a time TC5. After the next exposed charged area moves to the exposure device 3, the exposure device 3 exposes the charged next exposed area to form a latent image from the time T8 to a time T10 corresponding to a second period TEON. As a result of the further rotation of the photosensitive drum 1, the development and the transfer are performed.

At the time T9, the control circuit 7 actuates the brush power source 62 to be connected to the positive power source 64 in order to spit the attracted toner to a next non-exposed area of the photosensitive drum 1 that will not be exposed by the exposure device 3 before it reaches the exposure device 3 as shown in FIG. 6. The rotating brush 61 is supplied with the positive voltage during the period TF from the time T9 to a time T11.

The next non-exposed area having the spit toner moves to the charger 21 as a result of the continuous rotation of the photosensitive drum 1. During a period from a time TC5 to a time TC6, as shown in FIG. 3, the non-exposed area conveying the spit toner is charged at 600 V by the charger 21. Further, the next non-exposed area moves to the exposure device 3 as a result of the rotation of the photosensitive drum 1. During a period from the time T10 to a time T12, the exposure device 3 does not expose the non-exposed area of the photosensitive drum 1. Therefore, since the toner is spit to the non-exposed area, the spit toner does not interrupt the exposure light from the exposure device 3.

Furthermore, the next non-exposed area moves to the developing roller 44 as a further result of the rotation of the photosensitive drum 1. At that time as shown in FIG. 4, since the potential at the developing roller 44 (300 V) is less positive than that at the next non-exposed area of the photosensitive drum 1 (600 V), the spit toner on the next non-exposed area of the photosensitive drum 1 is removed from the next non-exposed area to the developing roller 44.

In this state, if the control circuit 7 detects that the control circuit 7 does not receive a next print start signal from the main control circuit 7 within a predetermined period from the time TPR2, until a time T13, the exposure device 3 does not expose the photosensitive drum 1. Furthermore, when a predetermined period TH passes after the time T13, the control circuit 7 stops the main driver 10, and the developing device driver 52. Furthermore, the control circuit 7 stops voltage supply of rotating brush 61, charger 21, the developing roller 44 and the transfer roller 56.

According to the embodiment, when the exposed area passes the rotating brush 61 before reaching the exposure device 3, the rotating brush 61 is supplied with the negative voltage, which is less positive than the potential of the photosensitive drum 1 conveying the residual toner. Therefore, the rotating brush 61 attracts the residual toner remaining on the photosensitive drum 1 to the rotating brush 61 and does not spit the toner to the exposed area. As a result, when the exposed area, on which the toner is not accumulated, reaches the exposure device 3, the light from the exposure device 3 reaches the surface of the photosensitive drum 1. Furthermore, since when the non-exposed area passes the rotating brush 61 before reaching the exposure device 3, the rotating brush 61 is supplied with the positive voltage, which is more positive than the potential of the photosensitive drum 1. Therefore, the rotating brush 61 spits the attracted toner in the rotating brush 61 to the non-exposed area of the photosensitive drum 1. Since the non-exposed area of the photosensitive drum 1 is not exposed, the spit toner does not interrupt the light from the exposure device 3. Furthermore, the spit toner on the non-exposed area is removed to the developing roller 44 when the non-exposed area reaches the developing roller 44. Therefore, the spit toner is reused in the developing device for developing a new latent image formed on the photosensitive drum 1.

As a result, the image forming apparatus requires only one rotating brush member 61 for dealing with the residual toner on the photosensitive drum 1. Therefore, compared to the conventional apparatus, which requires two components for dealing with the residual toner, the apparatus of the embodiment is lighter and less bulky.

Although the rotating brush 61 has been described to be supplied with the negative voltage (−300 V) to attract the residual toner on the photosensitive drum 1 to the rotating brush 61, the rotating brush 61 may be supplied with a voltage which is less positive than the potential of the photosensitive drum 1 conveying the residual toner For example, referring again to FIG. 7, the voltage may be 0 V, which is less positive than the potential (50 V) of the photosensitive drum 1 conveying the toner.

Figure 8:
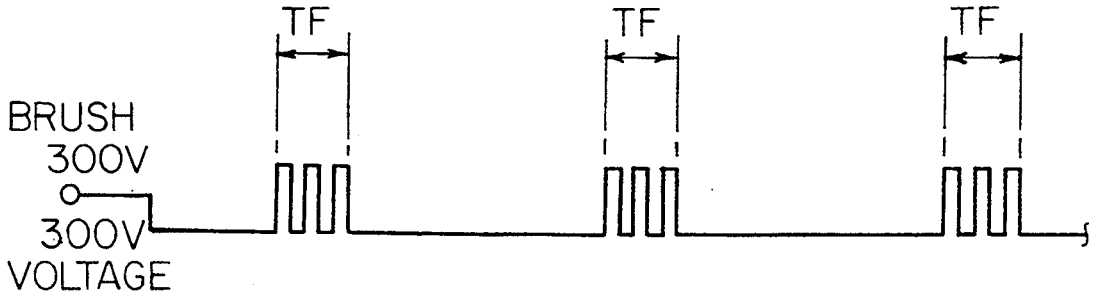
FIG. 8 is a diagram illustrating another way of supplying voltage to the rotating brush.

Furthermore, although in the embodiment, the rotating brush 61 has been described to be supplied with the positive voltage during the period TF to spit the attracted toner in the rotating brush 61 to the photosensitive drum 1, the rotating brush 61 may be supplied with an intermittent positive voltage during the period TF as shown in FIG. 8.

Figure 9:
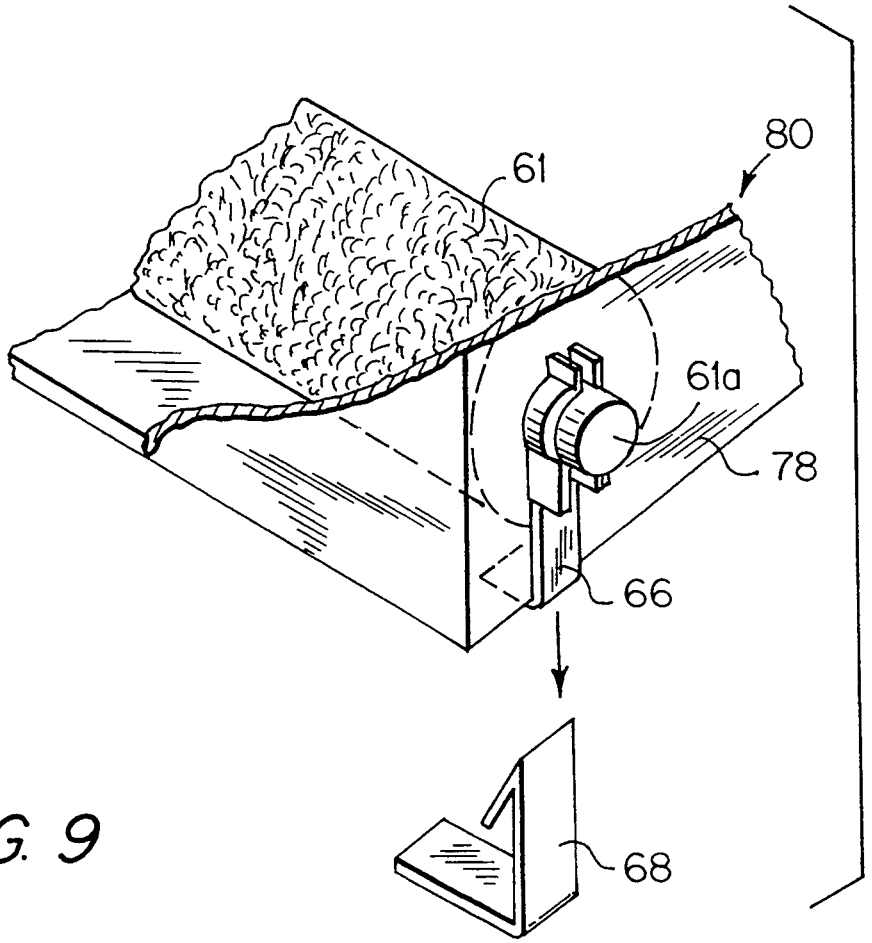
FIG. 9 is a partial schematic view illustrating a power supply terminal provided in the apparatus in FIG. 1.

Furthermore, the brush power sources 63, 64 and the switch 62 may be provided out of the housing of the process unit 80 as shown in FIG. 9. A shaft 61*a* of the rotating brush 61 is supported by the side cover 78 of the process unit 80. The shaft 61*a* is engaged with a conductive fitting 66.

The conductive fitting 66 has an engagement portion for being engaged with the shaft 61*a* of the rotating brush 61 and a contacting portion attached to the side cover 78 for contacting a terminal 68 provided in the image forming apparatus. The terminal 68 is electrically connected to the switch 62. When the process unit 80 is installed into the image forming apparatus, the conductive fitting 66 contacts the terminal 68. As a result, the rotating brush 61 is supplied with one of the power sources 63, 64, through the terminal 68 and the conductive fitting 66.

In this way, the rotating brush is electrically connected to the switch 62 in accordance with the installation of the process unit. Therefore, the process unit 80 does not require two power sources for supplying voltage to the rotating brush 61. This results in the miniaturization and the lightening of the process unit 80.

Figure 10:
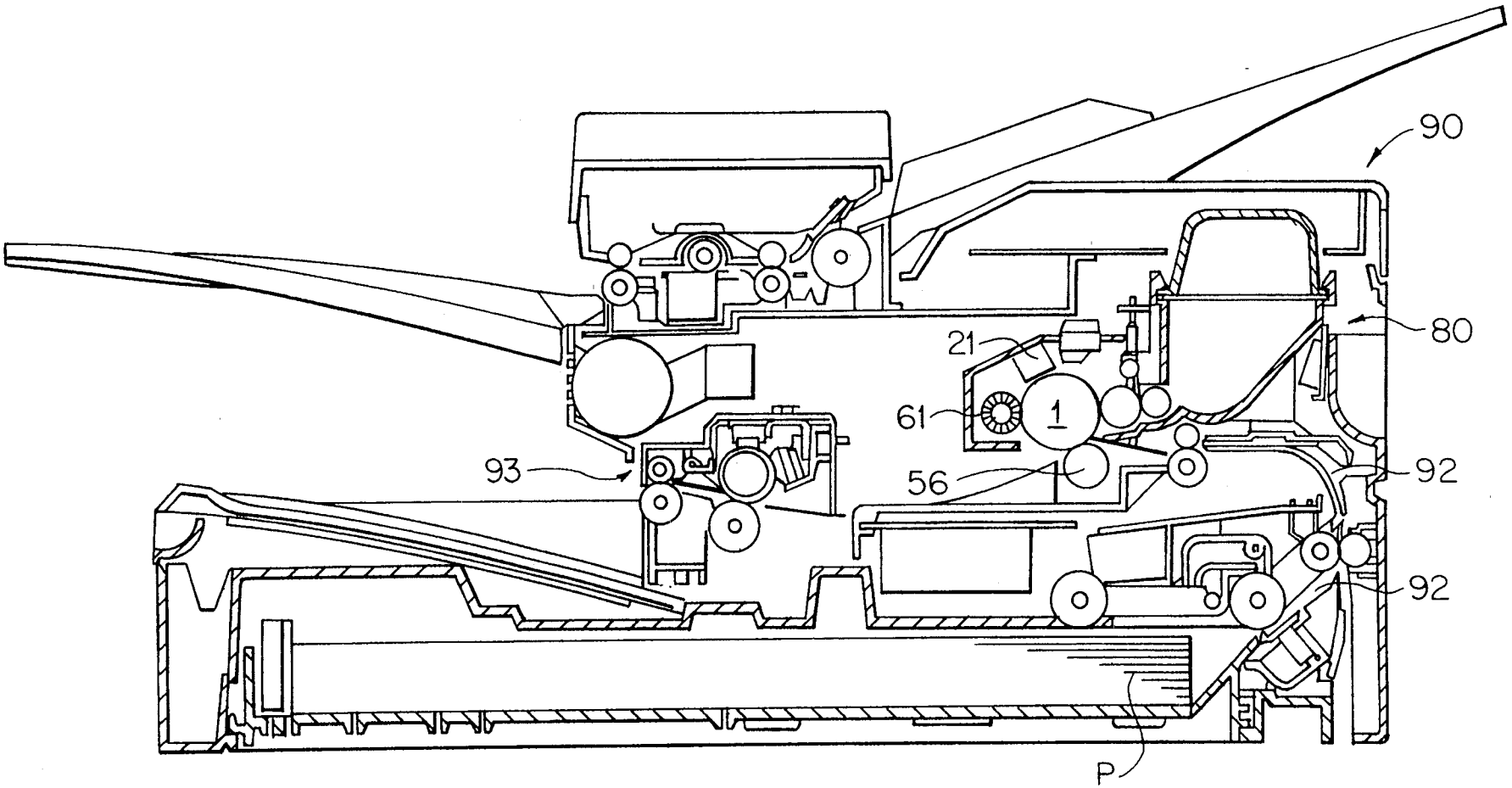
FIG. 10 is a schematic view of a facsimile apparatus incorporating the apparatus in FIG. 1.

FIG. 10 shows an image forming apparatus 90 such as a facsimile apparatus including the process unit 80. The process unit 80 is mountable into the housing of the image forming apparatus 90. The paper P is transferred through a path 92 to the transfer roller 61. After the toner image is transferred on the paper P at the transfer device 51, the paper P is transferred to a fixing device 93 for fixing the toner image on the paper P by the pressure of rollers. After that the paper P exits from the image forming apparatus 90.

Figure 11:
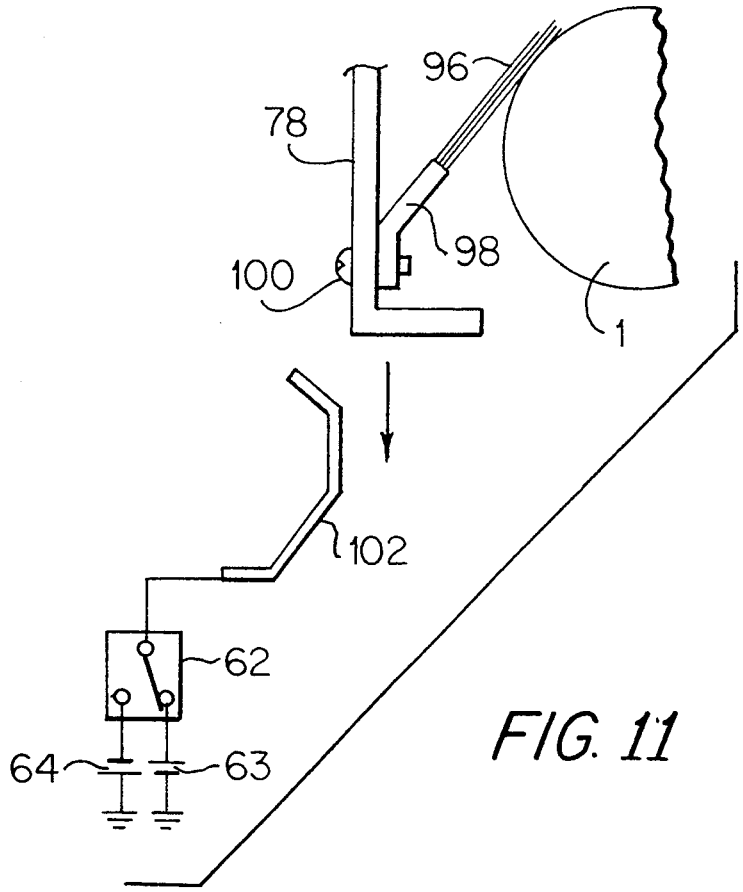
FIG. 11 is a partial cross-sectional view illustrating another embodiment of the present invention.
Figure 12:
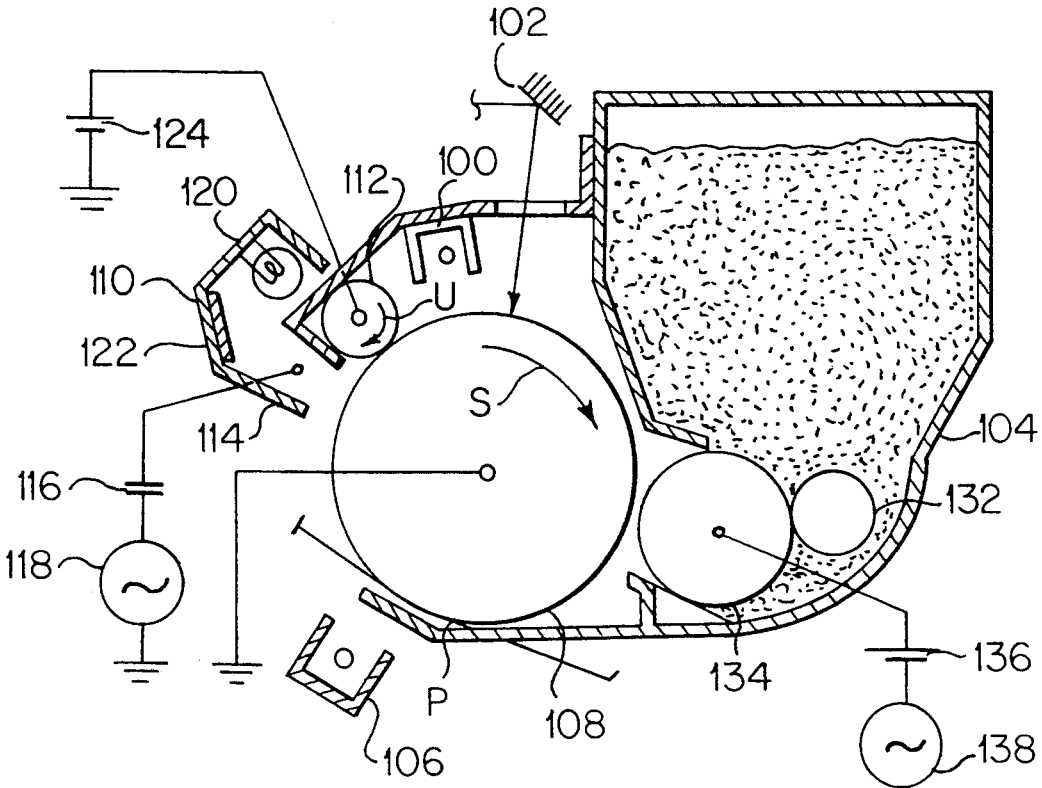
FIG. 12 is a schematic view illustrating a conventional image forming apparatus.

Although, in the embodiment, the brush member has been described to be the rotating brush 61, the brush member can alternatively be a brush 96 having a base and a tip contacting the photosensitive drum 1 as shown in FIG. 11. The brush 96 is fixed on the side cover 78 of the process unit by a conductive material 98 and a conductive screw 100. The screw 100 is electrically connected to the brush 96 via the conductive material 98.

A terminal 102, switch 62, and positive, negative power sources 63, 64 are provided in the image forming apparatus 90. The terminal 102 is connected to the switch 62. When the process unit 80 is installed in the image forming apparatus, the screw 100 contacts the terminal 102. In this way, the brush 96 is electrically connected to the switch 62, which is alternatively connected to one of the positive power source 63 and the negative power source 64. Therefore, the process unit 80 does not require the two power sources 63, 64 for supply voltage to brush 96. This results in the miniaturization and the lightening of the process unit 80.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

We claim:

1. An image forming apparatus comprising:

a photosensitive member;

charging means for charging the photosensitive member;

exposing means for exposing the charged photosensitive member to form a latent image and a non-exposed area on the photosensitive member;

developing means for developing the latent image with toner to form a developed toner image on the photosensitive member;

transferring means for transferring the developed toner image to a sheet-like material;

a brush member arranged along the photosensitive member and arranged between the transferring means and the charging means;

first voltage supply means for supplying a first voltage which is sufficient to attract residual toner remaining on the photosensitive member to the brush member during a first period when an exposed area that is to be exposed by the exposing means passes the brush member, the first period occurring before the exposed area reaches the exposing means;

second voltage supply means for supplying a second voltage which is sufficient to spit the attracted toner attracted in the brush member at the photosensitive member during at least a part of a second period when a non-exposed area that is on a different area of the photosensitive member from the exposed area passes the brush member, the second period occurring before the non-exposed area reaches the exposing means; and removing means for removing the spit toner on the photosensitive member by transferring the spit toner from the photosensitive member to the developing means, the removing means being operated simultaneously with the developing means.

2. The image forming apparatus of claim 1 wherein the developing means includes a developing roller rotating in contact with the photosensitive member at a developing position.

3. The image forming apparatus of claim 2 wherein the charging means is arranged at a charging position and the brush member is arranged at a brush position, and the photosensitive member has a first point which is located at the charging position and a second point which is located at the brush position when the charging means starts charging the photosensitive member, and the developing means comprises a driver mechanism for starting driving the developing roller at a time between when the first point reaches the developing position and when the second point reaches the developing position inclusive.

4. The image forming apparatus of claim 1 wherein the image forming apparatus is enclosed in a housing, and the brush member is a rotating brush having a shaft supported by the housing, and the brush member is rotated in contact with the photosensitive member.

5. The image forming apparatus of claim 1 wherein the developing means further includes a developing roller and a developing blade, wherein the toner is charged by friction between the developing roller and the developing blade.

6. The image forming apparatus of claim 1 wherein the photosensitive member is positively charged.

7. The image forming apparatus of claim 1 wherein the image forming apparatus is enclosed in a housing, and the brush member has a base and a tip, the base being fixed to the housing and the tip contacting the photosensitive member.

8. A process unit mountable into an image forming apparatus, the image forming apparatus including a transfer device, a first terminal and voltage supply connected to the first terminal, the process unit comprising:

a photosensitive member;

charging means for charging the photosensitive member;

exposing means for exposing the charged photosensitive member to form an exposed area including a latent image and a non-exposed area on the photosensitive member;

developing means for developing the latent image with toner to form a developed toner image on the photosensitive member;

a transfer portion for allowing the developed toner image to be transferred from the photosensitive member to a sheet-like material by the transfer device;

a brush member arranged along the photosensitive member between the transferring portion and the charging means; a second terminal electrically connected to the brush member;

first voltage supply means for supplying a first voltage which is sufficient to attract residual toner remaining on the photosensitive member to the brush member during a first period when an exposed area that is to be exposed by the exposing means passes the brush member, the first period occurring before the exposed area reaches the exposing means;

second voltage supply means for supplying a second voltage which is sufficient to spit the attracted toner in the brush member at the photosensitive member during at least a part of a second period when a non-exposed area that is on a different area of the photosensitive member from the exposed area passes the brush member, the second period occurring before the non-exposed area reaches the exposing means; and removing means for removing the spit toner on the photosensitive member by transferring the spit toner from the photosensitive member to the developing means, the removing means being operated simultaneously with the developing means, wherein, when the process unit is mounted into the image forming apparatus, the first terminal contacts the second terminal.

9. The process unit of claim 8 wherein the process unit is enclosed in a housing and the second terminal is provided outside of the housing.

10. The process unit of claim 8 wherein the brush member is a rotating brush having a shaft supported by the housing, and the brush member is rotated in contact with the photosensitive member.

11. The process unit of claim 8 wherein the developing means includes a developing roller rotating in contact with the photosensitive member.

12. The process unit of claim 9 wherein the charging means is arranged at a charging position and the brush member is arranged at a brush position, and the photosensitive member has a first point which is located at the charging position and a second point which is located at the brush position when the charging means starts charging the photosensitive member, and the developing means comprises a driver mechanism for driving the developing roller when or after the first position reaches the developing position and when or before the second position reaches the developing position.

13. The process unit of claim 9 wherein the developing means further includes a developing roller and a developing blade, and the toner is charged by friction between the developing roller and the developing blade.

14. The process unit of claim 8 wherein the photosensitive member is positively charged.

15. The process unit of claim 9 wherein the brush member has a base and a tip, the base being fixed to the housing by the second terminal, the tip contacting the photosensitive member.

* * * * *

UNITED STATES PATENT AND TRADEMARK OFFICE

CERTIFICATE OF CORRECTION

PATENT NO. : 5,438,397

DATED : August 1, 1995

INVENTOR(S) : Yoshiaki Okano et al.

It is certified that error appears in the above-indentified patent and that said Letters Patent is hereby corrected as shown below:

The title page, showing an illustrative figure, should be deleted and substitute therefor the attached title page.

The drawing sheets 1, 4, 5 & 6 of 7, should be deleted to be replaced with drawing sheets consisting of drawing Figs. as shown on the attached pages.

Signed and Sealed this

Twenty-fifth Day of June, 1996

*Attest:*

Bruce Lehman

BRUCE LEHMAN

*Attesting Officer*

*Commissioner of Patents and Trademarks*

United States Patent [19]

Okano et al.

[11] Patent Number: 5,438,397

[45] Date of Patent: Aug. 1, 1995

[54] IMAGE FORMING APPARATUS

[75] Inventors: Yoshiaki Okano; Tetsuya Nakamura, both of Tokyo, Japan

[73] Assignee: Kabushiki Kaisha Toshiba, Kanagawa, Japan

[21] Appl. No.: 216,867

[22] Filed: Mar. 24, 1994

[51] Int. Cl.[6] ..... G03G 15/06

[52] U.S. Cl. ..... 355/269; 355/301

[58] Field of Search ..... 355/296, 301, 303, 297, 355/246, 269, 270; 118/652, 653, 661; 15/256.52

[56] References Cited

U.S. PATENT DOCUMENTS

| | | | |
|---|---|---|---|
| 4,754,304 | 6/1988 | Ohashi et al. | 355/270 |
| 4,769,676 | 9/1988 | Mukai et al. | 355/269 |
| 4,999,679 | 3/1991 | Corbin et al. | 355/303 |
| 5,124,757 | 6/1992 | Ikegawa | 355/296 |
| 5,200,789 | 4/1993 | Oshiumi | 355/296 |
| 5,233,398 | 8/1993 | Nimura et al. | 355/301 |
| 5,237,377 | 8/1993 | Harada et al. | 355/301 |
| 5,241,327 | 8/1993 | Rubin et al. | 346/76 L |
| 5,257,079 | 10/1993 | Lange et al. | 355/303 |

*Primary Examiner*—A. T. Grimley
*Assistant Examiner*—T. A. Dang
*Attorney, Agent, or Firm*—Finnegan, Henderson, Farabow, Garrett & Dunner

[57] ABSTRACT

An image forming apparatus includes a brush member arranged along a photosensitive member and arranged between a transfer roller means and a charger. The image forming apparatus further includes a first voltage supply for supplying a first voltage which is sufficient to attract residual toner remaining on the photosensitive member to the brush member during a first period when an exposed area that is to be exposed by the exposing means passes the brush member, the first period occurring before the exposed area reaches the exposing means, and a second voltage supply for supplying a second voltage which is sufficient to spit the attracted toner attracted in the brush member at the photosensitive member during at least a part of a second period when a non-exposed area that is on a different area of the photosensitive member from the exposed area passes the brush member, the second period occurring before the non-exposed area reaches the exposing means.

15 Claims, 7 Drawing Sheets

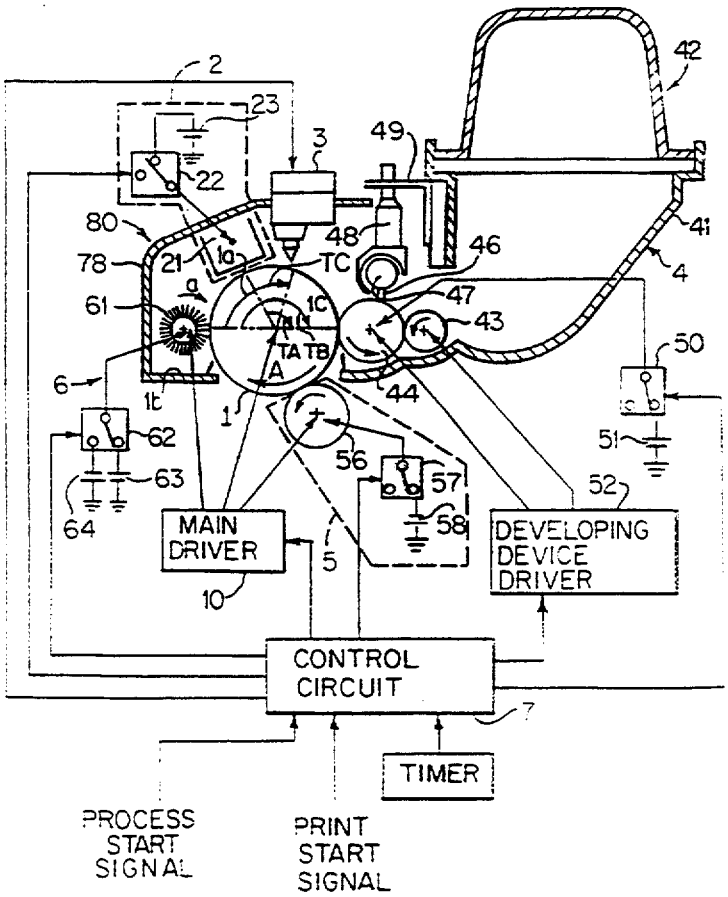

UNITED STATES PATENT AND TRADEMARK OFFICE

CERTIFICATE OF CORRECTION

PATENT NO. : 5,438,397 page 3 of 6

DATED : August 1, 1995

INVENTOR(S) : Yoshiaki OKANO et al.

It is certified that error appears in the above-indentified patent and that said Letters Patent is hereby corrected as shown below:

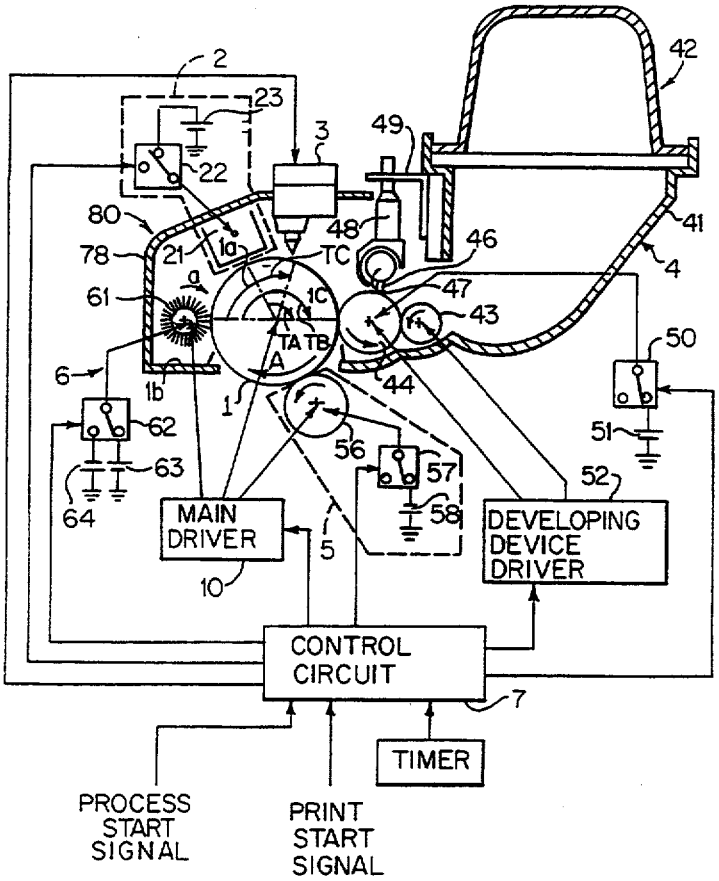

FIG. 1

UNITED STATES PATENT AND TRADEMARK OFFICE

CERTIFICATE OF CORRECTION

PATENT NO. : 5,438,397

DATED : August 1, 1995

INVENTOR(S) : Yoshiaki OKANO et al.

It is certified that error appears in the above-indentified patent and that said Letters Patent is hereby corrected as shown below:

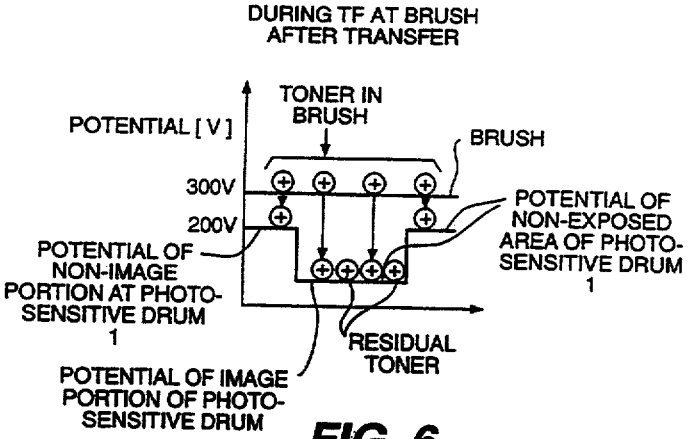

FIG. 6

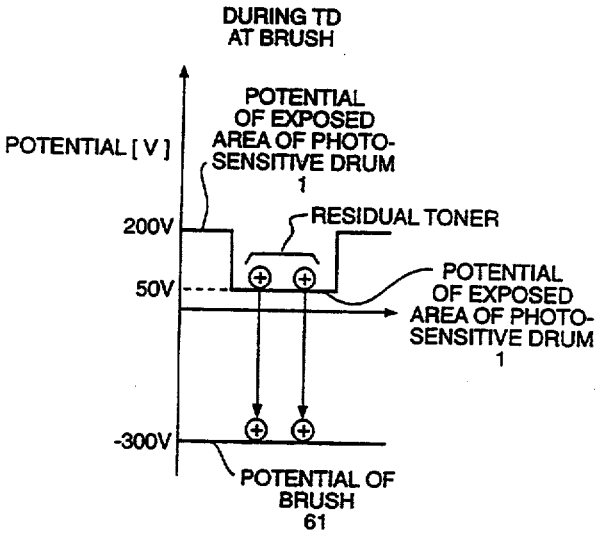

FIG. 7

UNITED STATES PATENT AND TRADEMARK OFFICE

CERTIFICATE OF CORRECTION

PATENT NO. : 5,438,397 Page 5 of 6

DATED : August 1, 1995

INVENTOR(S) : Yoshiaki OKANO et al.

It is certified that error appears in the above-indentified patent and that said Letters Patent is hereby corrected as shown below:

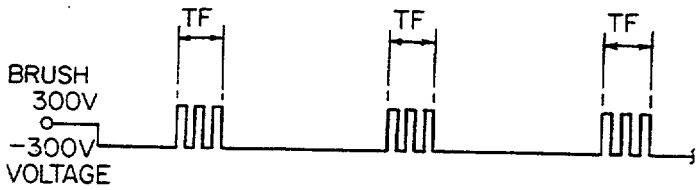

FIG. 8

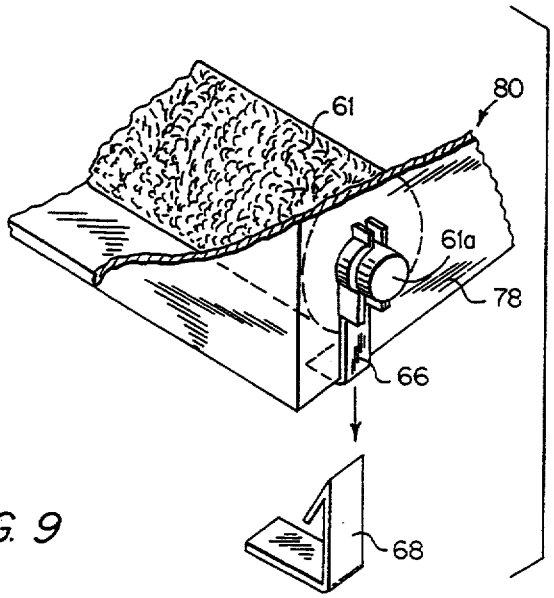

FIG. 9

UNITED STATES PATENT AND TRADEMARK OFFICE

CERTIFICATE OF CORRECTION

PATENT NO. : 5,438,397 Page 6 of 6

DATED : August 1, 1995

INVENTOR(S) : Yoshiaki OKANO et al.

It is certified that error appears in the above-indentified patent and that said Letters Patent is hereby corrected as shown below:

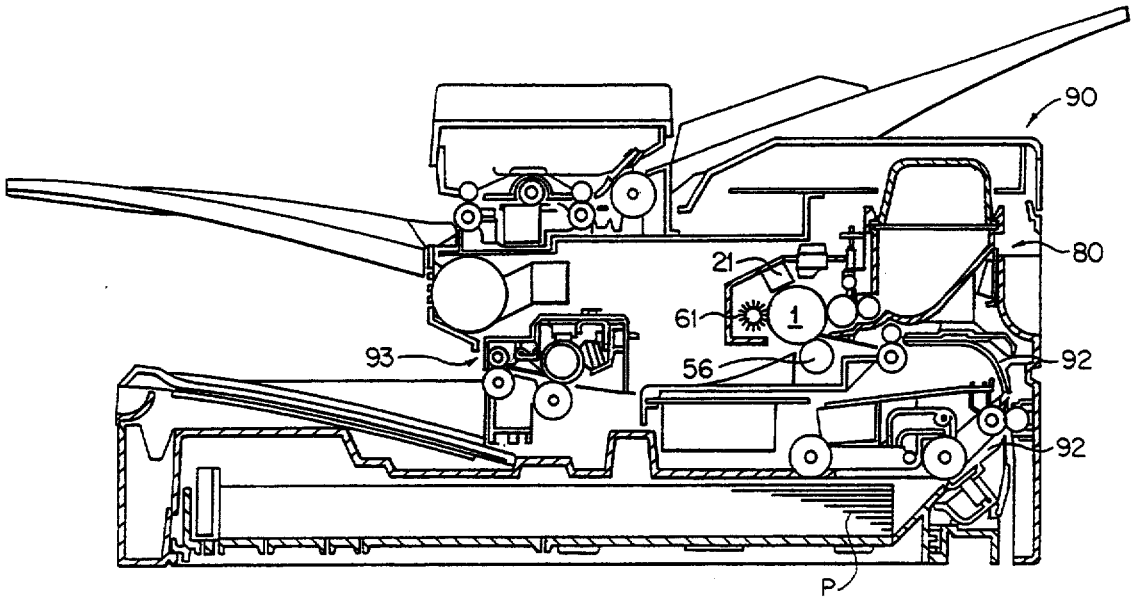

FIG. 10